US010253566B2

(12) United States Patent
Nieminen et al.

(10) Patent No.: US 10,253,566 B2
(45) Date of Patent: Apr. 9, 2019

(54) ROCK DRILLING RIG

(71) Applicant: SANDVIK MINING AND CONSTRUCTION OY, Tampere (FI)

(72) Inventors: Ilpo Nieminen, Tampere (FI); Johannes Valivaara, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 103 days.

(21) Appl. No.: 15/287,224

(22) Filed: Oct. 6, 2016

(65) Prior Publication Data

US 2017/0101860 A1 Apr. 13, 2017

(30) Foreign Application Priority Data

Oct. 9, 2015 (EP) ..... 15189089

(51) Int. Cl.

| | |
|---|---|
| ***E21B 7/02*** | (2006.01) |
| ***E21B 19/14*** | (2006.01) |
| ***E21B 19/18*** | (2006.01) |
| ***E21B 44/00*** | (2006.01) |

(52) U.S. Cl.

CPC ..... *E21B 7/025* (2013.01); *E21B 19/14* (2013.01); *E21B 19/18* (2013.01); *E21B 44/00* (2013.01)

(58) Field of Classification Search

CPC ..... E21B 44/00; E21B 7/025

See application file for complete search history.

(56) References Cited

U.S. PATENT DOCUMENTS

| | | | | |
|---|---|---|---|---|
| 6,615,932 | B2 * | 9/2003 | Huhdanmaki | E21B 19/14 173/185 |
| 2002/0036101 | A1 | 3/2002 | Huhdanmaki et al. | |
| 2006/0120892 | A1 * | 6/2006 | Muona | E21B 44/06 417/375 |
| 2010/0307827 | A1 * | 12/2010 | Piipponen | E21D 20/003 175/52 |
| 2016/0112678 | A1 * | 4/2016 | Suvanen | E21B 7/022 175/24 |

FOREIGN PATENT DOCUMENTS

| | | | |
|---|---|---|---|
| CN | 101517190 | A | 8/2009 |
| CN | 102066690 | A | 5/2011 |
| CN | 103249904 | A | 8/2013 |
| CN | 103770689 | A | 5/2014 |
| DE | 29502091 | U1 | 4/1995 |
| WO | 0061907 | A1 | 10/2000 |
| WO | 02/103162 | A1 | 12/2002 |
| WO | 2008054302 | A1 | 5/2008 |
| WO | 2009080876 | A1 | 7/2009 |
| WO | 2009156574 | A1 | 12/2009 |
| WO | 2012072870 | A1 | 6/2012 |

* cited by examiner

*Primary Examiner* — Caroline N Butcher
(74) *Attorney, Agent, or Firm* — Corinne R. Gorski

(57) ABSTRACT

A rock drilling rig and method for rock drilling, the rock drilling rig having a first boom unit including a first rock drilling machine provided with a tool and drill bit at the distal end of the tool, and a second boom unit including at least one rack for accommodating at least one drill bit. The first boom unit and the first rock drilling machine therein are configured to collect a drill bit from the at least one rack in the second boom unit.

14 Claims, 3 Drawing Sheets

ROCK DRILLING RIG

RELATED APPLICATION DATA

This application claims priority under 35 U.S.C. § 119 to EP Patent Application No. 15189089.4, filed on Oct. 9, 2015, which the entirety thereof is incorporated herein by reference.

FIELD OF THE INVENTION

The present invention relates to a rock drilling rig and a method of providing a rock drilling rig with a tool of a rock drilling machine with a drill bit.

BACKGROUND

Rock drilling rig include a carrier and at least one boom unit having a drilling unit. Rock drilling rigs and drilling units therein may be used, for example, in tunnelling or in other rock breaking operations in mines or excavating sites. A drilling unit typically has at least one rock drilling machine with a tool that is formed of one or more interconnected drill rods or drill pipes. At a distal end of the tool there is a drill bit. During drilling the drill bits become worn or may be broken and must therefore be replaced. It is also possible that a beginning of a hole, i.e. a reamer hole, is drilled with a drill bit having a smaller diameter and the drilling of the hole is thereafter continued with a drill bit having a larger diameter. In that case the drill bits must be interchanged at some point of the drilling.

Changing of the drill bits is typically carried out manually by an operator of the rock drilling rig. The changing of the drill bits manually requires the operator to leave a cabin or canopy of the rock drilling rig and possibly enter into an area with unsupported or unreinforced roof of a tunnel, which may be unsafe. The changing of the drill bits may also involve cumbersome working positions and lifting or otherwise handling of possibly heavy items.

SUMMARY

To overcome the above disadvantages, the present disclosure is directed to a rock drilling rig and a method for providing a tool to a rock drilling machine with a drill bit.

According to a first aspect of the present disclosure, there is provided a rock drilling rig including a carrier, a first boom unit having a first rock drilling machine to be provided with the tool and the drill bit at the distal end of the tool, and a second boom unit having at least one rack for accommodating at least one drill bit. The first boom unit and the first rock drilling machine therein are configured to collect the drill bit from the at least one rack in the second boom unit.

Accordingly, the operator does not need to exit a cabin or a canopy of the rock drilling rig and change the drill bits manually, the operator thus remaining safe in the cabin or in the canopy of the rock drilling rig. This also makes it possible to utilize automatic drilling, i.e. drilling without any active human supervision, or drilling through a remote access by an operator being positioned outside of the drilling site, for example in an office, since the operator does not need to stay at the drilling site for changing the drill bit. The change of the drill bits may also be carried out faster than before whereby the efficient operating time of the rock drilling rig may be increased.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE DRAWINGS

For the sake of clarity, the figures show some embodiments of the invention in a simplified manner. In the figures, like reference signs identify like elements.

DETAILED DESCRIPTION

Figure 1:
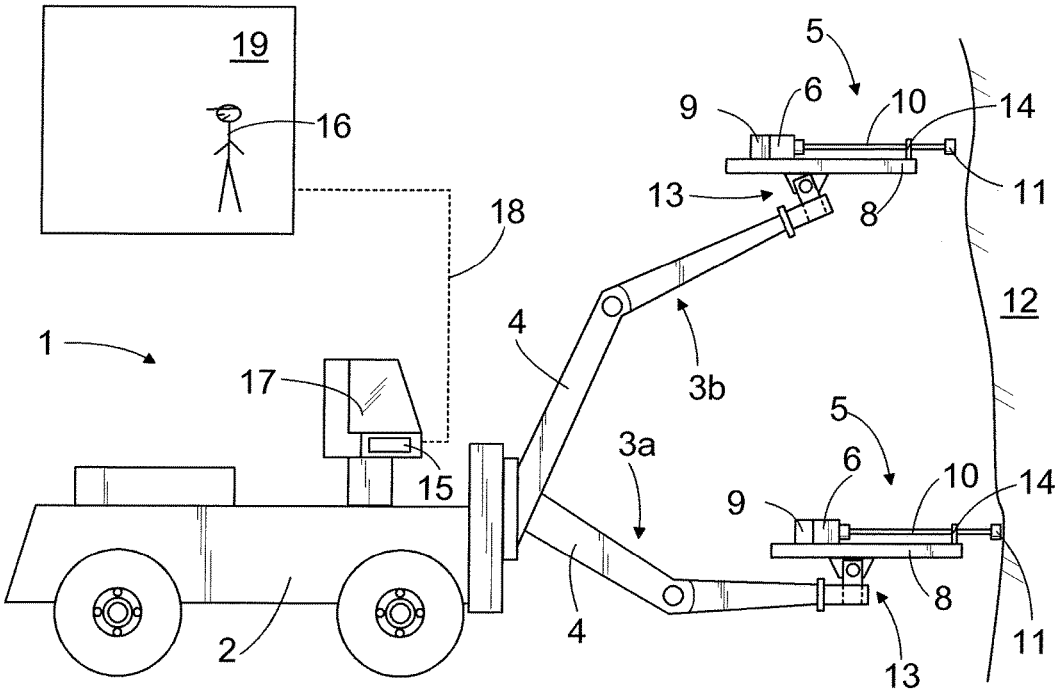
FIG. 1 is a schematic side view showing a rock drilling rig.

FIG. 1 is a schematic side view of a rock drilling rig 1 which may be used for excavating a rock cavern, for example. The rock drilling rig 1 according to FIG. 1 includes a movable carrier 2 and two boom units, i.e. a first boom unit 3*a* and a second boom unit 3*b*, a general reference sign for a boom unit being 3. Both of the boom units 3*a*, 3*b* include a boom 4 and a drilling unit 5 arranged at a distal end of the boom 4, i.e. at the end of the boom unit pointing away from the carrier 2 of the rock drilling rig 1.

Figure 2:
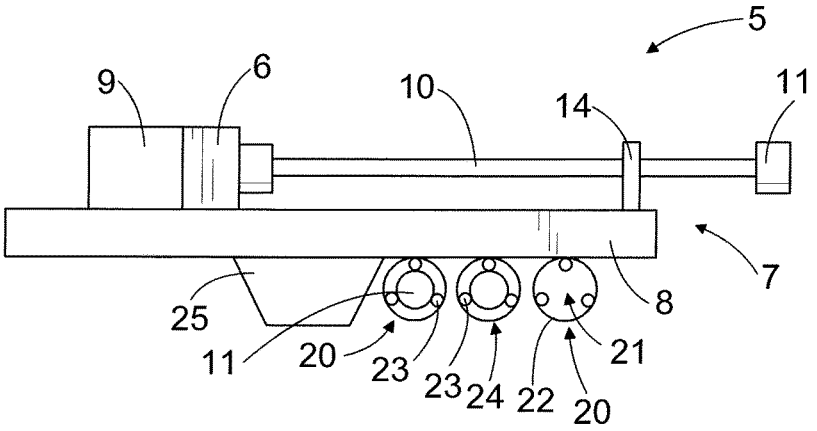
FIG. 2 is a schematic side view of a drilling unit.

FIG. 2 is a schematic side view of the drilling unit 5. The drilling unit 5 in the first boom unit 3*a* includes a first rock drilling machine 6*a* and the drilling unit 5 in the second boom unit 3*b* includes a second rock drilling machine 6*b*, a general reference sign for a rock drilling machine being 6.

Each drilling unit 5 also has a feed assembly 7. The feed assembly 7 includes a feed beam 8 and a feed device 9. The rock drilling machine 6*a*, 6*b* is arranged on the respective feed beam 8 and the respective feed device 9 is arranged to move the rock drilling machine 6*a*, 6*b* with respect to the feed beam 8.

The rock drilling machines 6*a*, 6*b* further include a tool 10 formed of a number of drill rods or drill pipes and a drill bit 11 at a distal end of the tool 10, the distal end of the tool 10 being the end of the tool 10 pointing away from the rock drilling machine 6*a*, 6*b*. The tool 10 and the drill bit 11 at the distal end thereof enables impact pulses given by a percussion device, which for the sake of clarity is not shown, to be transmitted to a rock 12 to be drilled.

The feed assembly 7 is arranged at the distal end of the boom 4 with a cradle 13, through which a position or an alignment of the feed assembly 7 and the respective rock drilling machine 6*a*, 6*b* thereon may be altered with respect to the boom 4. The feed assembly 7 further includes a retainer clamp 14 at the distal end of the feed beam 8 to support the tool 10 of the rock drilling machine 6*a*, 6*b*.

The rock drilling rig 1 further has at least one control unit 15 configured to control actuators of the rock drilling rig 1 for controlling operations of the boom units 3*a*, 3*b*, feed assemblies 7 and the rock drilling machines 6*a*, 6*b*, for instance. The control unit 15 may be a computer or a corresponding device, and it may include a user interface, including a display device, as well as control means, such as a keyboard or a joystick, for communicating commands and information to the control unit 15.

The rock drilling rig 1 may be an at least partly autonomously operating rock drilling rig 1, i.e. a rock drilling rig 1 operating at least some time without any active human supervision. Alternatively, the rock drilling rig 1 may be an actively operated rock drilling rig 1, that is operated at a drilling site by an operator 16 being positioned in a cabin 17 or a canopy 17 of the rock drilling rig 1 or through a remote access 18 by an operator 16 being positioned outside of the drilling site, for example in an office 19.

The rock drilling rig 1 of FIG. 1 includes two boom units 3*a*, 3*b* each of which has the drilling unit 5 for rock drilling. Alternatively, the rock drilling rig 1 may be provided with more than two boom units being provided with the drilling unit 5. Furthermore, the rock drilling rig 1 may be provided with one boom unit being provided with the drilling unit 5, and with at least one additional boom unit being provided with a man basket boom or a basket boom for personnel lift operations and/or with a boom unit being provided with a screen handler boom or a mesh handler boom comprising means and articles used for reinforcing a roof or a wall of the drilling site. Furthermore, the rock drilling rig 1 may be provided with two or more boom units being provided with the drilling units 5, and additionally with at least one additional boom unit comprising the basket boom and/or the mesh handler boom.

Figure 3:
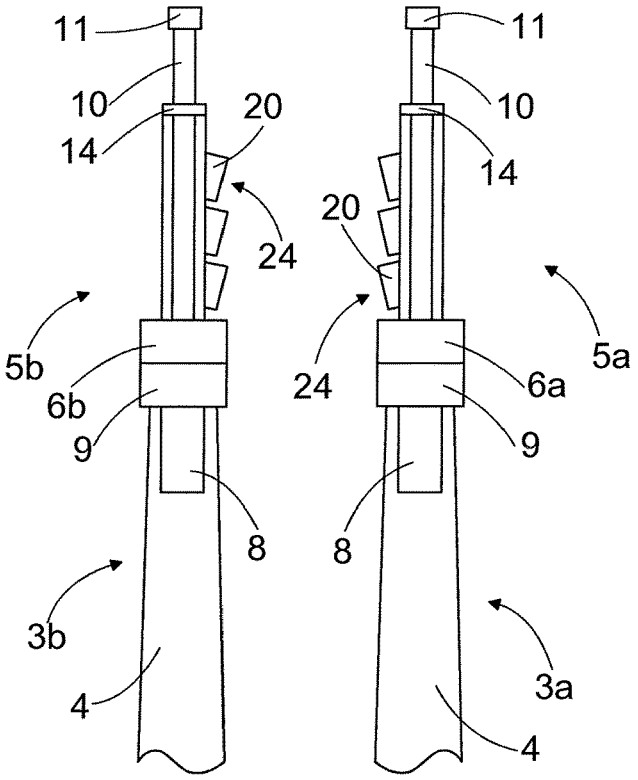
FIGS. 3 and 4 are schematic upper views of boom units of the rock drilling rig of FIG. 1.
Figure 4:
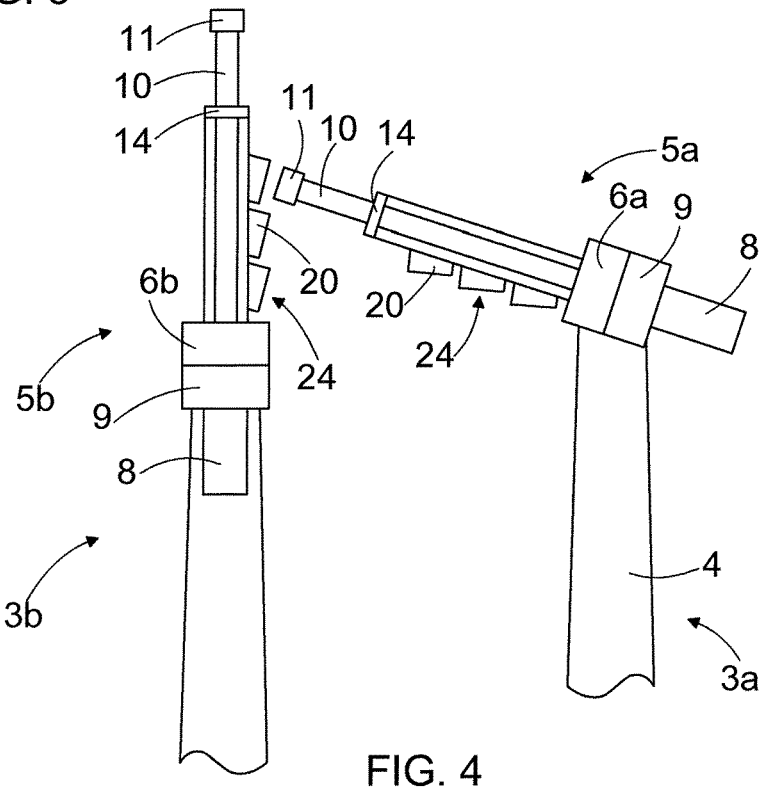

The drilling unit 5 of FIG. 2 includes a plurality of racks 20, for example, three racks 20. The rack 20 have an internal space 21 for accommodating at least one drill bit 11. The racks 20 are shown in FIGS. 3 and 4, which are schematic upper views of the boom units 3*a*, 3*b* of the rock drilling rig 1 of FIG. 1 and respective drilling units 5*a*, 5*b* attached thereto, wherein both of the boom units 3*a*, 3*b* include a plurality of racks 20. The racks 20 in the first boom unit 3*a* of FIGS. 3 and 4 are arranged to accommodate drill bits 11 intended to be used in the second rock drilling machine 6*b* arranged at the second boom unit 3*b*, and the racks 20 in the second boom unit 3*b* of FIGS. 3 and 4 are arranged to accommodate drill bits 11 intended to be used in the first rock drilling machine 6*a* arranged at the first boom unit 3*a*.

The at least one rack 20 is attached to the feed assembly 7 of the drilling unit 7, and more particularly, at a bottom surface 8' of the feed beam 8 of the respective feed assembly 7. The rack 20 includes a frame 22 or a casing 22 providing the internal space 21 for accommodating at least one drill bit 11 to be accommodated into the rack 20. The rack 20 also has at least one alignment and retaining element 23. For example, in the embodiment disclosed, there are three alignment and retaining elements 23, which may be spring elements. The purpose of the alignment and retaining elements 23 is to centralize the at least one drill bit 11 in the internal space 21 of the rack 20 and to retain the at least one drill bit 11 in the internal space 21 of the rack 20 until intentionally removed therefrom through an open front end 24 of the rack 20, through which open front end 24 the rack 20 may receive the drill bit 11 or release it.

The racks 20 shown in the embodiment of FIGS. 2, 3 and 4 are arranged consecutively in one line at the bottom surface 8' of the feed beam 8 between the retainer clamp 14 at a distal end of the feed beam 8 and a support 25 for fastening of the feed beam 8 to the cradle 13. This arrangement provides that the boom unit 3 and the respective drilling unit 5 therein that will collect the drill bit 11 from the rack 20 in another boom unit 3, as explained later referring to FIGS. 3 and 4, do not need to turn to a high turning angle when collecting the drill bit 11 from the rack 20 in another boom unit 3 or when leaving the drill bit 11 in the rack 20 in another boom unit 3. In order to minimize the needed turning angle of the boom unit 3 and the drilling unit 5 therein, the open front end 24 of the rack 20 may be directed backwards relative to the longitudinal direction of the rock drilling rig 1, as shown in FIGS. 3 and 4.

As mentioned shortly above, the racks 20 in the first boom unit 3*a* are arranged to accommodate the drill bits 11 reserved for the second rock drilling machine 6*b* in the second boom unit 3*b*, whereby the second rock drilling machine 6*b* will leave the used drill bit 11 presently attached to the tool 10 of the second rock drilling machine 6*b* in one rack 20 in the first boom unit 3*a* and collect a new drill bit 20 from another rack 20 in the first boom unit 3*a*. Correspondingly, the racks 20 in the second boom unit 3*b* are intended to accommodate the drill bits 11 reserved for the first rock drilling machine 6*a* in the first boom unit 3*a*, whereby the first rock drilling machine 6*a* will leave the used drill bit 11 presently attached to the tool 10 of the first rock drilling machine 6*a* in one rack 20 in the second boom unit 3*b* and collect a new drill bit 20 from another rack 20 in the second boom unit 3*b*.

Figure 5:
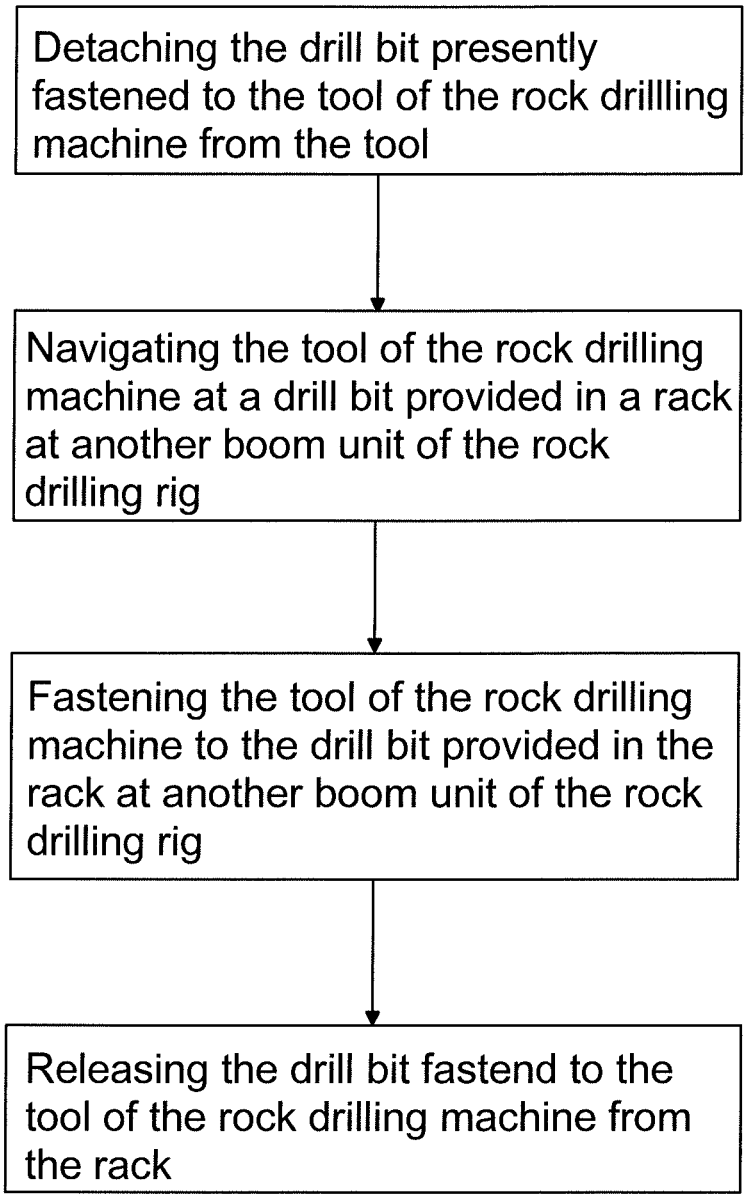
FIG. 5 discloses schematically a method for changing a drill bit.

As set forth herein, rock drilling machine 6 in a boom unit 3 can be provided with a new drill bit 11 as illustrated in the method steps disclosed schematically in FIG. 5. Also, the specific method steps and alternative embodiments of the solution, will be described with reference to FIGS. 3 and 4, wherein the first rock drilling machine 6*a* in the first boom unit 3*a* is provided with a new drill bit 11. FIG. 3 presents the boom units 3*a*, 3*b* and the respective drilling units 5*a*, 5*b* therein in a normal position during the drilling operation and FIG. 4 presents the boom units 3*a*, 3*b* and the respective drilling units 5*a*, 5*b* therein in one position taking place during a changing of the drill bit 11 of the first rock drilling machine 6*a*.

For changing a drill bit 11 of tool 10 of rock drilling machine 6 in a boom unit 3, the drill bit 11 presently fastened to the tool 10 of the rock drilling machine 6 is detached from the tool 10 of the rock drilling machine 6. After detaching the drill bit 11 from the tool 10 the distal end of the tool 10 of the rock drilling machine 6 is navigated to a drill bit 11 provided in rack 20 at another boom unit 3 of the rock drilling rig 1.

After navigating the distal end of the tool 10 of the rock drilling machine 6 at the drill bit 11 provided in the rack 20 in another boom unit 3 of the rock drilling rig 1, the distal end of the tool 10 is fastened to the drill bit 11 in the rack 20 in the other boom unit 3 of the rock drilling rig 1.

After fastening the distal end of the tool 10 to the drill bit 11 in the rack 20 in another boom unit 3 of the rock drilling rig 1, the drill bit 11 fastened to the distal end of the tool 10 of the rock drilling machine 6 is released from the rack 20.

When a tool 10 of a rock drilling machine 6 is not yet provided with any drill bit 11 at the end thereof, the first method step listed above are eliminated.

According to an embodiment for detaching the drill bit 11 from the distal end of the tool 10 of the first rock drilling machine 6*a*, the first boom unit 3*a* and/or the drilling unit 5*a* therein is displaced relative to the second boom unit 3*b* and the drilling unit 5*b* therein in such a way that the drill bit 11 at the distal end of the tool 10 of the first rock drilling machine 6*a* in the first boom unit 3*a* is navigated at a rack 20 in the second boom unit 3*b*, which rack 20 having a free internal space 21 for receiving the used drill bit 11 of the first rock drilling machine 6*a*. The first boom unit 3*a* and the respective drilling unit 5*a* therein are schematically shown in this position in FIG. 4. The first boom unit 3*a* and the drilling unit 5*a* therein may be displaced relative to the second boom unit 3*b* and/or the drilling unit 5*b* therein by moving the first boom unit 3*a* relative to the second boom unit 3*b* and/or by moving the drilling unit 5*a* of the first boom unit 3*a* relative to the boom 4 of the first boom unit 3*a*.

Furthermore, in operating situations having a very limited space available in the rock cavern, such that the drilling unit 5*a* and/or the first boom unit 3*a* is not able to move or turn into a position, the first rock drilling machine 6*a* is able to leave an old drill bit 11 in the rack 20 in the second boom unit 3*b* and/or to collect the new drill bit 11 from the rack 20 in the second boom unit 3*b*, also the second boom unit 3*b* and/or the drilling unit 5*b* therein may be moved or turned relative to the first boom unit 3*a* and/or the drilling unit 5*a* therein so that the first rock drilling machine 6*a* is able to leave the old drill bit 11 in the rack 20 in the second boom unit 3*b* and/or to collect the new drill bit 11 from the rack 20 in the second boom unit 3*b*. In this case, it may be said that the second boom unit 3*b* and/or the drilling unit 5*b* therein is operated to have an optimal position relative to the first rock drilling machine 6*a* for the tool 10 of the first rock drilling machine 6*a* in the first boom unit 3*a* to approach the rack 20 in the second boom unit 3*b*.

After the drill bit 11 at the distal end of the tool 10 of the first rock drilling machine 6*a* is navigated to a rack 20 in the second boom unit 3*b*, which rack 20 in the second boom unit 3*b* has free internal space 21 for receiving the used drill bit 11 of the first rock drilling machine 6*a*, the tool 10 of the rock drilling machine 6*a* is fed forward into the free internal space 21 of the rack 20 in the second boom unit 3*b* as long as the drill bit 11 is set against counterpart elements in the rack 20. Thereafter the tool 10 of the first rock drilling machine 6*a* is rotated so as to detach the drill bit 11 from the tool 10 and the tool 10 is retracted out of the rack 20, the drill bit 11 remaining in the internal space 21 of the rack 20.

Thus, according to an embodiment for detaching the drill bit from the distal end of the tool of the rock drilling machine, the drill bit 11 at the distal end of the tool 10 of the rock drilling machine 6*a*, 6*b* is navigated to free space 21 in at least one rack 20 provided in another boom unit 3*a*, 3*b* of the rock drilling rig 1, the space 21 intended to accommodate at least one drill bit 11 in the rack 20, and the tool 10 of the rock drilling machine 6*a*, 6*b* is fed forward for the drill bit 11 to be received and supported in the free space 21 in the rack 20, and the tool 10 of the rock drilling machine 6*a*, 6*b* is rotated for detaching the drill bit 11 from the distal end of the tool 10.

According to an embodiment for detaching the drill bit 11 from the distal end of the tool 10 of the first rock drilling machine 6*a*, the drill bit 11 is first impacted against the rock 12 to be drilled to untighten bit couplings between the drill bit 11 and the tool 10. Thereafter, the tool 10 of the rock drilling machine 6*a* is rotated for detaching the drill bit 11 from the distal end of the tool 10. The detached drill bit 11 may be dropped on a ground or in a basket laid on the ground, for example, or it may be carried into the free internal space 21 in the rack 20 arranged in the second boom unit 3*b*.

According to an embodiment for detaching the drill bit 11 from the distal end of the tool 10 of the first rock drilling machine 6*a*, the tool 10 of the first rock drilling machine 6*a* is retracted so that the drill bit 11 is located at the retainer clamp 14 at the distal end of the feed beam 8. Thereafter, the retainer clamp 14 is operated to grip to the drill bit 11 and the tool 10 of the rock drilling machine 6*a* is rotated to untighten and detach the drill bit 11 from the distal end of the tool 10. The detached drill bit 11 may be dropped on a ground or in a basket laid on the ground, for example, or it may be carried into the free internal space 21 in the rack 20 arranged in the second boom unit 3*b*.

After detaching the drill bit 11 from the tool 10 of the first rock drilling machine 6*a*, the distal end of the tool 10 of the first rock drilling machine 6*a* is navigated to a rack 20 arranged at the second boom unit 3*b* of the rock drilling rig 1, which rack 20 is provided with the drill bit 11 to be taken in use next. For this to take place the first boom unit 3*a* and the drilling unit 5*a* therein may be further displaced relative to the second boom unit 3*b* and/or the drilling unit 5 therein by moving or turning the first boom unit 3*a* relative to the second boom unit 3*b* and/or by moving or turning the drilling unit 5*a* of the first boom unit 3*a* relative to the boom 4 of the first boom unit 3*a*. Additionally, the second boom unit 3*b* may be moved or turned relative to the first boom unit 3*a* and/or the drilling unit 5*b* of the second boom unit 3*b* may be moved or turned relative to the boom 4 of the second boom unit 3*b*. In that case, again, the second boom unit 3*b* is operated to have an optimal position for the tool 10 of the first rock drilling machine 6*a* in the first boom unit 3*a* to approach the rack 20 in the second boom unit 3*b*.

After the distal end of the tool 10 of the first rock drilling machine 6*a* is navigated to the rack 20 provided with the drill bit 11 to be used next, the distal end of the tool 10 of the first rock drilling machine 6*a* is fed forward so as to make contact with the drill bit 11 in the rack 20. Thereafter, the tool 10 is rotated for tightening the drill bit 11 to the distal end of the tool 10. For releasing the drill bit 11 from the rack 20, the tool 10 of the first rock drilling machine 6*a* is retracted, whereby the tool 10 of the first rock drilling machine 6*a* and the new drill bit 11 at the distal end thereof are pulled out of the rack 20.

Corresponding actions are carried out when the drill bit 11 of the tool 10 in the second rock drilling machine 6*b* in the second boom unit 3*b* is changed. The control unit 15 of the rock drilling rig 1 is configured to control an operation of the boom units 3*a*, 3*b* and the drilling units 5*a*, 5*b* therein for changing or collecting the drill bit 11 for the tool 10 of the respective rock drilling machine 6*a*, 6*b*.

The control unit 15 is configured to, for changing or collecting the drill bit 11 for the tool 10 of the rock drilling machine 6*a*, 6*b*, to control at least one of the following operations: detaching the drill bit 11 from the distal end of the tool 10 of the rock drilling machine 6*a*, 6*b*; navigating the distal end of the tool 10 of the rock drilling machine 6*a*, 6*b* at a drill bit 11 in the rack 20 provided in another boom unit 3*a*, 3*b* of the rock drilling rig 1; fastening the distal end of the tool 10 of the rock drilling machine 6*a*, 6*b* to the drill bit 11 in the rack 20 provided in another boom unit 3*a*, 3*b* of the rock drilling rig 1; and releasing the drill bit 11 fastened to the distal end of the tool 10 of the rock drilling machine 6*a*, 6*b* from the rack 19.

A need to change the drill bit 11 may arise from a decision of the operator of the rock drilling rig 1 or from a predetermined condition to be achieved in the drilling. That predetermined condition may, for example, be a change in a type of a hole to be drilled, an achievement of predetermined drilling meters for the drill bit, a breakage of the drill bit or a wear-out of the drill bit.

The operations for changing the drill bit may be controlled by the operator of the rock drilling rig. Preferably, at least some operations for changing the drill bit are controlled automatically by the control unit configured to control at least one operation of at least one boom unit and the respective rock drilling unit therein automatically in response to a control command initiated by at least one of an operator of the rock drilling rig and a predetermined condition being achieved in the drilling. The control unit may, for example, be pre-educated to repeat all the movement paths and positions of at least one of the boom units 3*a*, 3*b* and the rock drilling machines 6*a*, 6*b* and the tools 10 therein.

In this manner, the operator 16 does not need to exit the cabin 17 or the canopy 17 of the rock drilling rig 1 and change the drill bits 11 manually, whereby the operator 16 is safe in the cabin of the rock drilling rig 1 and does not need to be involved in cumbersome working positions or lifting or otherwise handling of heavy items. The change of the drill bits 11 may also be carried out faster than before, whereby the efficient operating time of the rock drilling rig 1 may be increased.

In the rock drilling rigs 1 having at least one boom unit 3 provided with the drilling unit 5 for rock drilling and also provided with at least one additional boom unit including a man basket boom and/or a mesh handler boom, the at least one rack 20 for accommodating the drill bits 11 for the rock drilling machines 6 may be attached to the boom unit having the man basket boom or the mesh handler boom. In that case, the rock drilling machine 6 in the at least one boom unit 3 provided with the drilling unit 5 will collect the drill bit 11 or leave the drill bit 11 in the rack 20 attached to that boom unit having the man basket boom and/or the mesh handler boom.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

The invention claimed is:

1. A rock drilling rig comprising:

a carrier; and at least two boom units, the at least two boom units including a first boom unit including a first rock drilling machine provided with a tool and a drill bit at a distal end of the tool, and a second boom unit including a second rock drilling machine provided with a tool and a drill bit at a distal end of the tool, the first boom unit having at least one rack for accommodating at least one drill bit, and the second boom unit having at least one rack for accommodating at least one drill bit, wherein the first boom unit and the first rock drilling machine therein are configured to collect the at least one drill bit from the at least one rack in the second boom unit, and wherein the second boom unit and the second rock drilling machine therein are configured to collect the at least one drill bit from the at least one rack in the first boom unit.

2. The rock drilling rig as claimed in claim 1, wherein each first and second boom unit includes a boom supported by the carrier, a cradle disposed at a distal end of the boom and a feed assembly installed on the cradle, the feed assembly including a feed beam to which a respective rock drilling machine is movably attached to, the at least one rack of each first and second boom being attached to a respective feed beam at a bottom of the feed beam.

3. The rock drilling rig as claimed in claim 2, wherein the at least one rack of each of the first and second boom units is installed on the respective feed beam on a portion of the feed beam between the cradle and a distal end of the feed beam.

4. The rock drilling rig as claimed in claim 1, wherein the rock drilling rig of each of the first and second boom units includes a control unit configured to control an operation of the respective boom unit and the rock drilling machine therein for changing or collecting the drill bit for the tool of the respective rock drilling machine.

5. The rock drilling rig as claimed in claim 4, wherein each control unit is configured to, for changing or collecting the drill bit for the tool of the respective rock drilling machine, to control at least one of the following operations:

detaching the drill bit from the distal end of the tool of the rock drilling machine;

navigating the distal end of the tool of the rock drilling machine at a drill bit in the rack provided in another boom unit of the rock drilling rig;

fastening the distal end of the tool of the rock drilling machine to the drill bit in the rack; and releasing the drill bit fastened to the distal end of the tool of the rock drilling machine from the rack.

6. The rock drilling rig as claimed in claim 4, wherein each control unit is configured to control at least one operation of at least the respective boom unit including the rock drilling machine automatically in response to a control command provided by an operator of the rock drilling rig.

7. The rock drilling rig as claimed in claim 4, wherein each control unit is configured to control, for changing or collecting the drill bit for the tool of the respective rock drilling machine, at least one operation of the boom unit and the rock drilling machine therein automatically in response to a control command initiated by a predetermined condition being achieved in the drilling.

8. The rock drilling rig as claimed in claim 7, wherein the predetermined condition is selected from the group comprising a change in a type of a hole to be drilled, an achievement of predetermined drilling meters for the drill bit, a breakage of the drill bit, and a wear-out of the drill bit.

9. The rock drilling rig as claimed in claim 1, wherein each rack includes at least one space for accommodating the at least one drill bit in the rack, and that each rack includes at least one alignment and retaining element to centralize and to retain the at least one drill bit in the space for accommodating the at least one drill bit.

10. A method for providing a tool of a rock drilling machine with a drill bit in a rock drilling rig having a carrier and at least two boom units, the method comprising the steps of:

providing the at least two boom units, the at least two boom units including a first boom unit including a first rock drilling machine provided with a tool and a drill bit at a distal end of the tool, and a second boom unit including a second rock drilling machine provided with a tool and a drill bit at a distal end of the tool, the first boom unit having at least one rack for accommodating at least one drill bit, and the second boom unit having at least one rack for accommodating at least one drill bit, wherein the first boom unit and the first rock drilling machine therein are configured to collect the at least one drill bit from the at least one rack in the second boom unit, and wherein the second boom unit and the second rock drilling machine therein are configured to collect the at least one drill bit from the at least one rack in the first boom unit;

navigating a distal end of the tool of each rock drilling machine to a drill bit in a rack provided in another boom unit of the rock drilling rig, the rack accommodating at least one drill bit;

fastening the drill bit to the distal end of the tool of the other rock drilling machine; and releasing the drill bit from the rack.

11. The method as claimed in claim 10, further comprising changing the drill bit of the tool of each rock drilling machine, wherein the drill bit is detached from the distal end of the tool, the distal end of the tool is navigated to a drill bit in the rack provided in another boom unit of the rock drilling rig, the distal end of the tool is fastened to the drill bit in the rack, and the drill bit fastened to the distal end of the tool is released from the rack.

12. The method as claimed in claim 11, wherein during detaching the drill bit from the distal end of the tool, the drill bit is impacted against a rock to be drilled to untighten its bit couplings, and the tool is rotated for detaching the drill bit from the distal end of the tool.

13. The method as claimed in claim 11, wherein providing during fastening of the drill bit to the tool of the rock drilling machine in another boom unit of the rock drilling rig relative to the boom unit where the rack is arranged, the boom unit provided with the rack including the drill bit is operated to have an optimal position for the tool of the rock drilling machine in another boom unit of the rock drilling rig to approach the respective rack for attaching the drill bit at the distal end of the tool.

14. The method as claimed in claim 10, wherein during fastening the tool to the drill bit in the rack, the distal end of the tool is fed forward so as to contact the drill bit in the rack, and the tool is rotated for tightening the drill bit to the distal end of the tool.

* * * * *